US007732688B2

(12) United States Patent
Hsieh

(10) Patent No.: US 7,732,688 B2
(45) Date of Patent: Jun. 8, 2010

(54) PORTABLE INSTRUMENT STAND

(75) Inventor: Wu-Hong Hsieh, Lu Chou (TW)

(73) Assignee: K.H.S. Musical Instrument Co., Ltd., Taipei (TW)

( * ) Notice: Subject to any disclaimer, the term of this patent is extended or adjusted under 35 U.S.C. 154(b) by 0 days.

(21) Appl. No.: 12/222,689

(22) Filed: Aug. 14, 2008

(65) Prior Publication Data

US 2010/0037747 A1 Feb. 18, 2010

(51) Int. Cl.
*G10D 3/00* (2006.01)

(52) U.S. Cl. ..... 84/327; 84/190

(58) Field of Classification Search ..... 84/327, 84/190, 421

See application file for complete search history.

(56) References Cited

U.S. PATENT DOCUMENTS

2005/0140188 A1* 6/2005 Zhurong et al. ..... 297/170

* cited by examiner

*Primary Examiner*—Jianchun Qin
(74) *Attorney, Agent, or Firm*—Posz Law Group, PLC

(57) ABSTRACT

A portable instrument stand has a base, two legs retractably mounted in the base, two arms foldably mounted in the base and a main cover mounted pivotally on the base. While unfolding the instrument stand, the legs, the main cover and the arms are sequentially unfolded in the base to allow a guitar or the like to be held on the arms. While folding the instrument stand, the arms and the legs are respectively stored in the base and the main cover is mounted on the base. The instrument stand is light, aesthetically pleasing, and has no sharp protrusions that may damage instruments being carried with the instrument stand or a person carrying the stand so is convenient.

7 Claims, 11 Drawing Sheets

PORTABLE INSTRUMENT STAND

BACKGROUND OF THE INVENTION

1. Field of the Invention

The present invention relates to an instrument stand, especially to an instrument stand that is collapsible for convenient carrying.

2. Description of the Prior Arts

Stringed instruments such as but not limited to guitars, violins, cellos and the like are held in hand, are generally hollow and have strings so must be handled carefully. When the stringed instrument is not being used, it is stored in a bag or is held by an instrument stand to prevent the guitar from falling down, being knocked, tripped over or stepped on. If accidentally hit an instrument body may be damaged causing their sound quality to be reduced and requiring remodeling or strings to break or snap. Moreover, the stringed instrument on the instrument stand can be shown to consumers in a guitar shop and left on stage or in studios during rest periods.

With reference to FIG. 10, a conventional instrument stand (90) has a base assembly (92), a stationary rod (91) and two arms (93).

The base assembly (92) is disposed on the ground and has a central shaft (921) and two assistant shafts (922). The central shaft (921) has a standing end, a pivot end and an elongated hole. The elongated hole of the central shaft (921) is formed through the central shaft (921). The assistant shafts (921) are pivotally connected to the central shaft (921). Each assistant shaft (922) has a standing end and a pivot end. The pivot end of the assistant shaft (922) pivotally connects to the pivot end of the central shaft (921).

The stationary rod (91) has a lower end and an upper end. The lower end of the stationary rod (91) is mounted through the elongated hole of the central shaft (921) of the bass assembly (92).

The arms (93) are pivotally connected to the bass assembly (92) and the stationary rod (91). Each arm (93) is pivotally connected to the stationary rod (91) and respectively to a corresponding assistant shaft (922) of the bass assembly (92) and has a supporting bracket (931) and a holding bracket (932). The supporting bracket (931) stands on the ground and pivotally connects the lower end of the stationary rod (91) and the corresponding assistant shaft (922) of the bass assembly (92). The holding bracket (932) is mounted on the supporting bracket (931), pivotally connects to the stationary rod (91) and has a pivot end and a hook. The pivot end of the holding bracket (932) pivotally connects to the upper end of the stationary rod (91). The hook of the holding bracket (932) prevents an instrument mounted on the arms (93) from falling forwards.

With further reference to FIG. 11, a guitar is mounted on the holding brackets (932) of the arms (93) while the arms (93) are unfolded.

However, the conventional instrument stand (90) retains a large legroom even after being folded. The different shafts, rods or brackets overlap with each other, have protruding ends and are inconvenient for carrying and must be carried separate from the instrument since they may cause damage to the instrument. Therefore, the conventional instrument stand (90) is usually placed and used in a specific position. Thus, if the conventional instrument stand (90) cannot be carried with the guitar, the guitar should be placed on the ground and causing exterior damage to due to ground contact or accidental damage. However, musicians frequently need to travel for performances, recordings, practices and the like and carry their instruments so require an instrument stand that is portable, easy to use, easy to carry, unlikely to cause damage and reliable.

To overcome the shortcomings, the present invention provides a portable instrument stand to mitigate or obviate the aforementioned problems.

SUMMARY OF THE INVENTION

The main objective of the present invention is to provide a portable instrument stand. The instrument stand has a base, two legs retractably mounted in the base, two arms foldably mounted in the base and a main cover mounted pivotally on the base.

While unfolding the instrument stand, the legs, the main cover and the arms are sequentially unfolded relative to the base. Therefore, a guitar or the like can be held on the arms.

While folding the instrument stand, the arms and the legs are respectively stored in the base and the main cover is mounted on the base. Thus, the instrument stand is folded compactly.

The instrument stand is light, aesthetically pleasing, and has no sharp protrusions that may damage instruments being carried with the instrument stand or a person carrying the stand so is convenient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
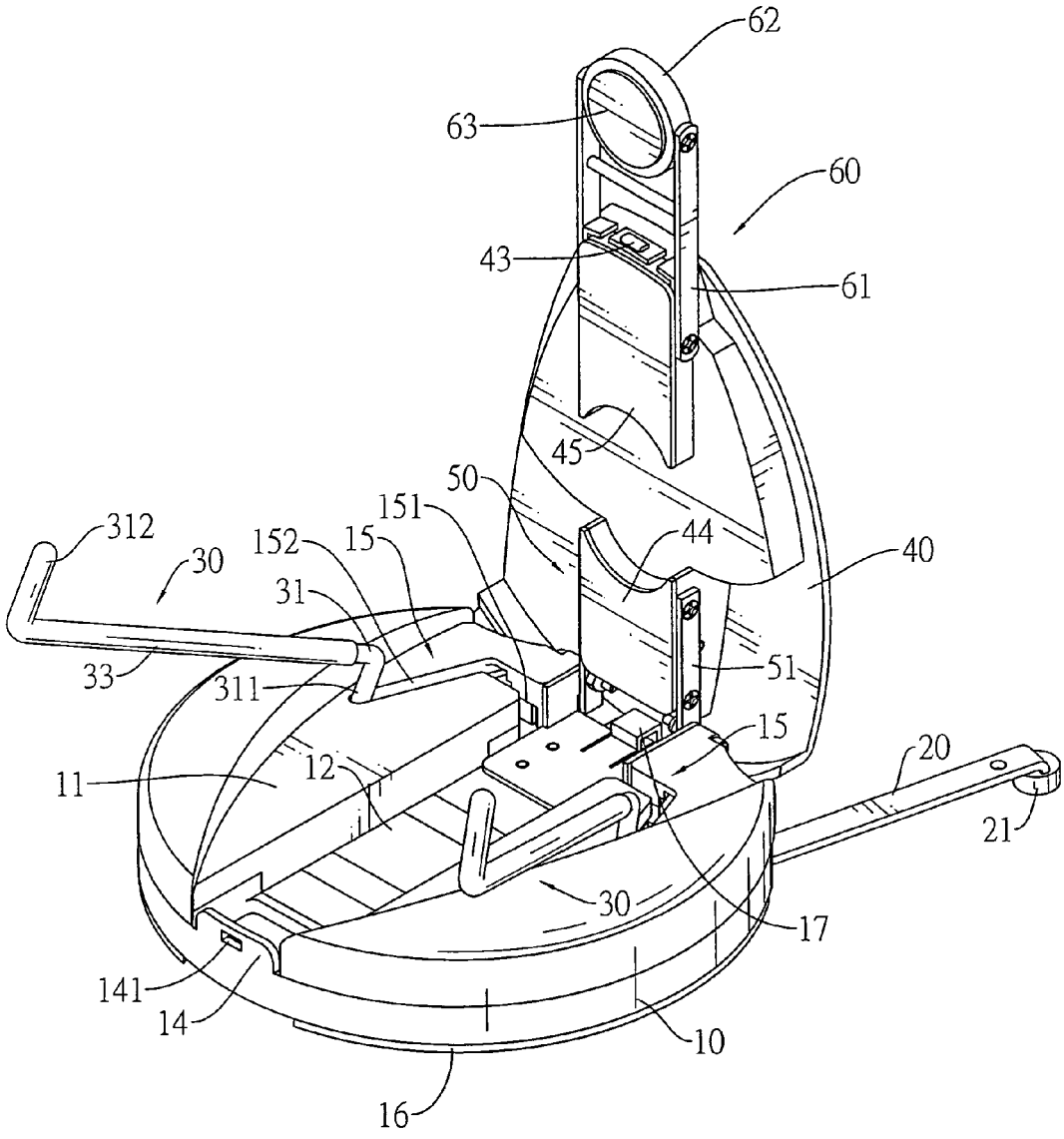
FIG. 1 is a perspective view of a portable instrument stand in accordance with the present invention, shown unfolded.
Figure 3:
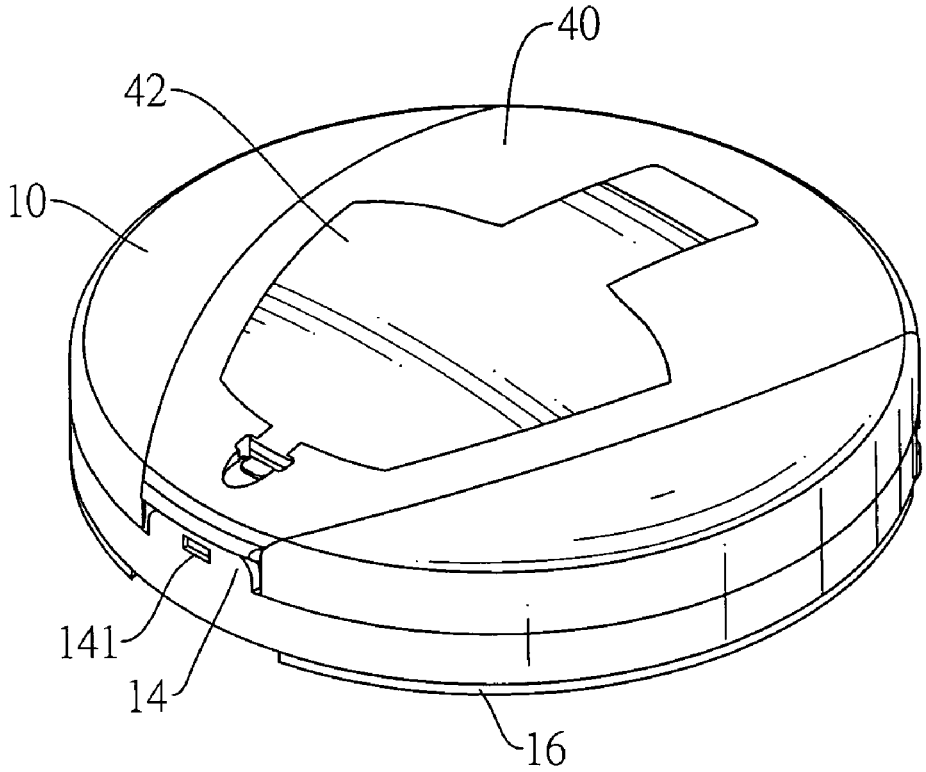
FIG. 3 is a perspective view of the instrument stand in FIG. 1, shown folded.
Figure 9:
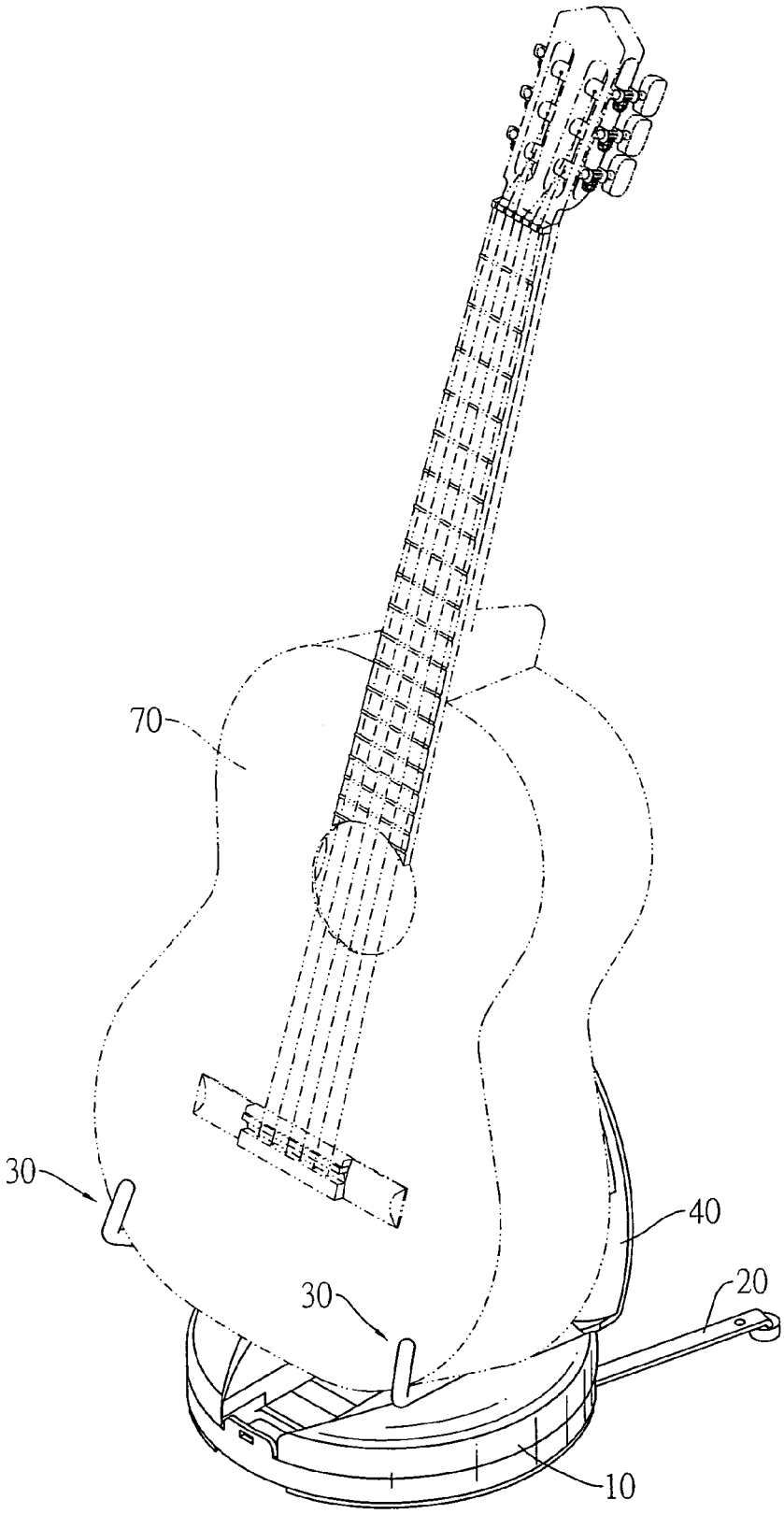
FIG. 9 is an operational perspective view of the instrument stand in FIG. 1, showing a guitar being held on the instrument stand.
Figure 10:
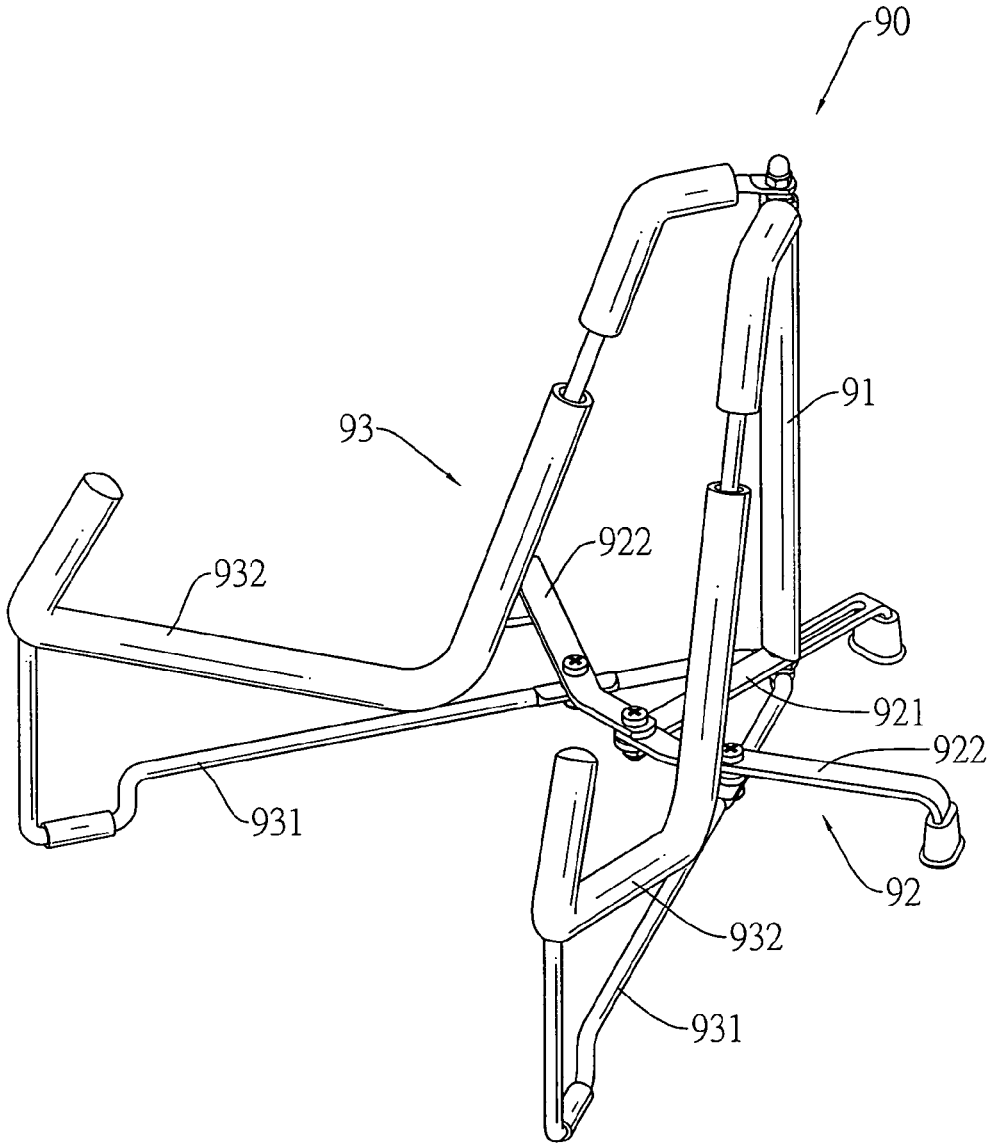
FIG.10 PRIOR ART
FIG. 10 is a perspective view of a conventional portable instrument stand in accordance with the prior art.
Figure 11:
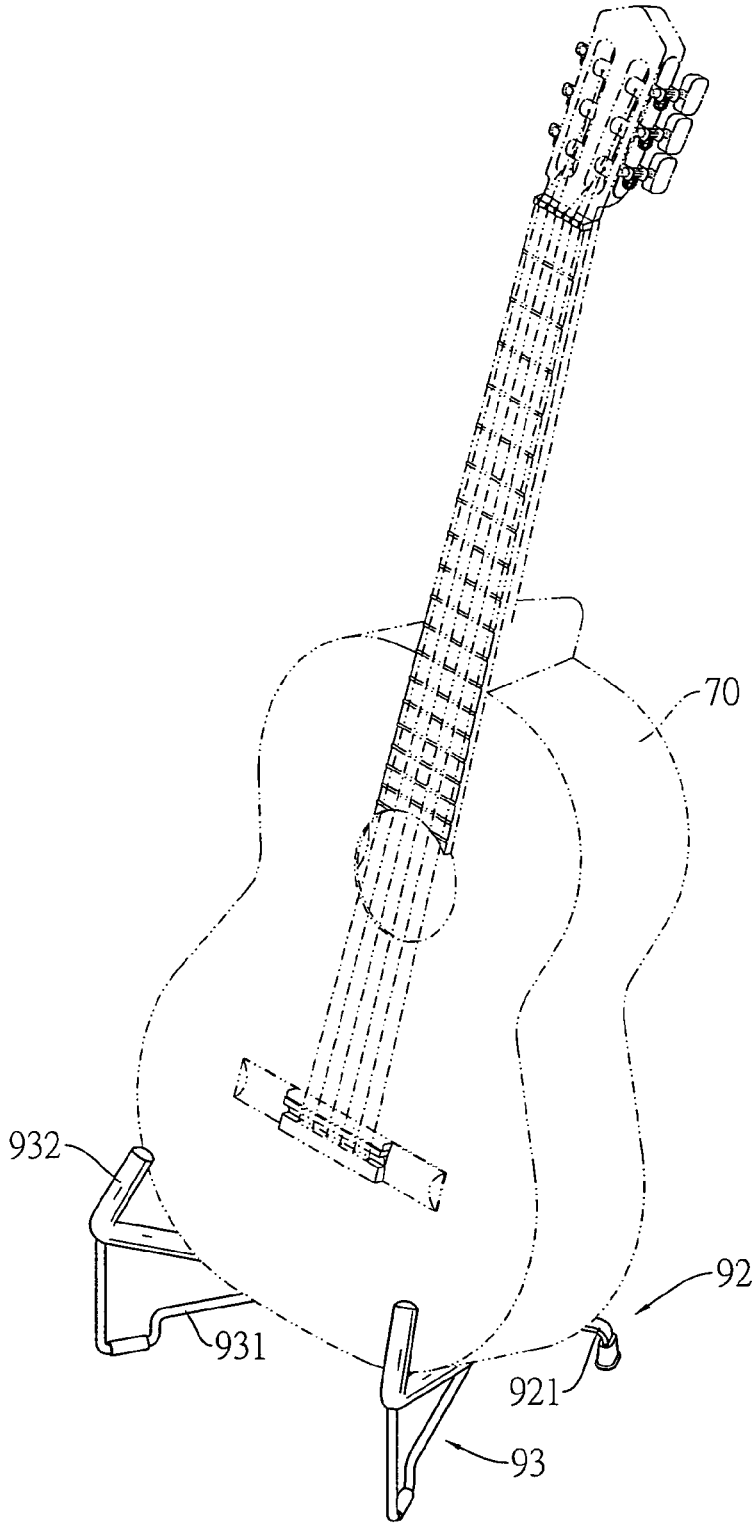
FIG.11 PRIOR ART
FIG. 11 is a perspective view of the conventional instrument stand in FIG. 10, showing a guitar being held on the conventional instrument stand.

With reference to FIGS. 1, 3 and 9, a portable instrument stand in accordance with the present invention may be used to mount a guitar (70) or the like and the instrument stand can be folded flat, maybe into a disk and comprises a base (10), two legs (20), two arms (30), a main cover (40), a pivot assembly (50) and a supporting assembly (60).

Figure 2:
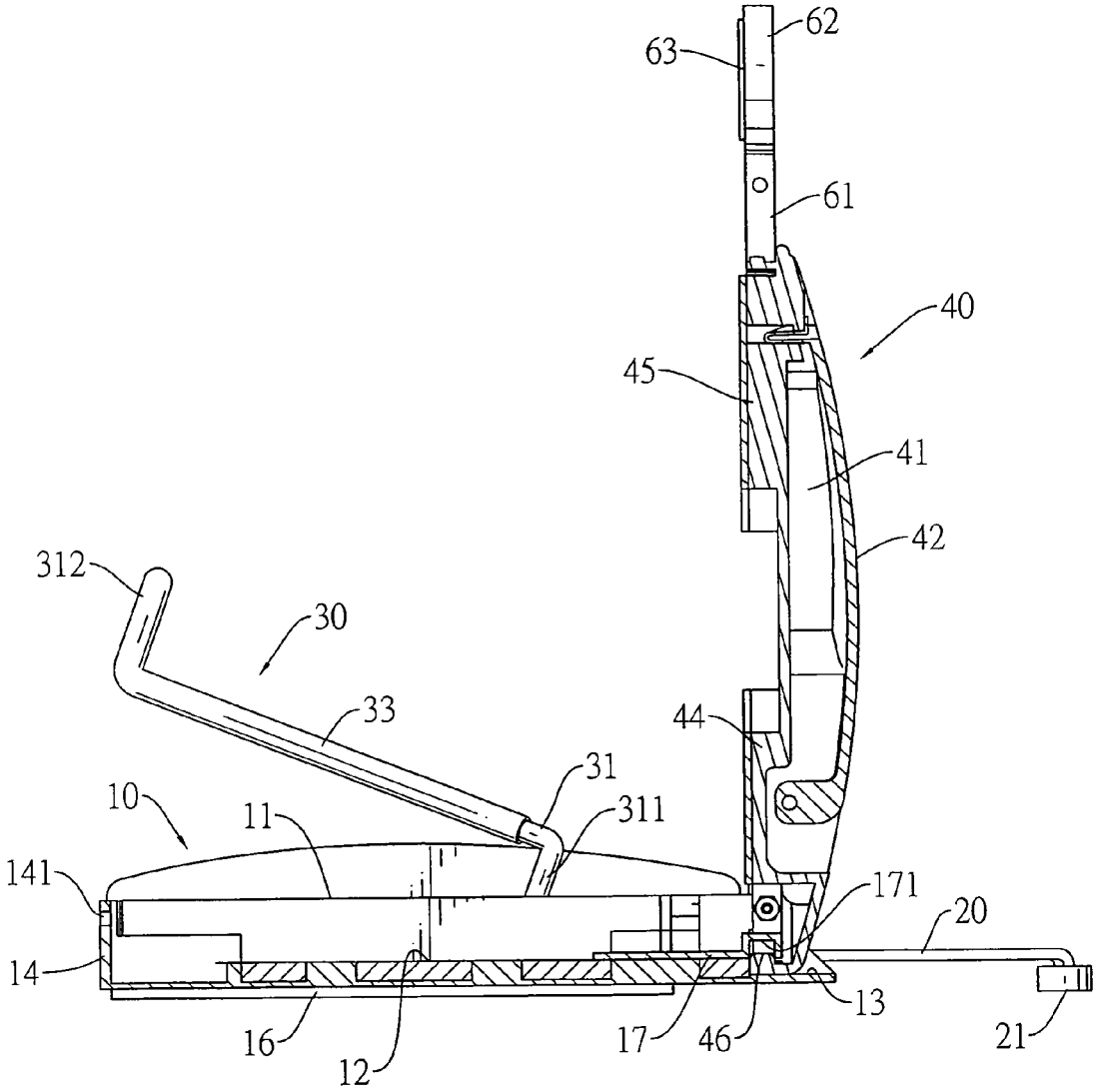
FIG. 2 is a side view in partial section of the instrument stand in FIG. 1.

With further reference to FIG. 2, the base (10) may be formed as a disk and has an upper surface, a side surface, a lower surface, a front end, a rear end, an optional positioning recess (13), an optional hook (17), an optional latch (14), two arm guides (15) and at least one optional pad (16).

The upper surface of the base (10) is stepped to form an outer platform (11) and an inner groove (12).

The outer platform (11) has a bottom.

The inner groove (12) has a bottom, two opposite sidewalls, a rear open end and a front open end.

The positioning recess (13) is formed in the side surface of the base (10), communicates with the inner groove (12) and has two opposite sides.

The hook (17) is mounted on the bottom of the inner groove (12) and adjacent to the rear open end of the inner groove (12).

The latch (14) is resilient, is formed on and independently protrudes from the bottom of the inner groove (12), may be adjacent to the front open end of the inner groove (12) and has two opposite sides and a latch hole (141). The latch hole (141) is formed through the latch (14).

The arm guides (15) are formed in the bottom of the outer platform (11), are respectively formed in the sidewalls of the inner groove (12) and communicate with the inner groove (12). Each arm guide (15) has a guiding section (152) and a folding section (151). The folding section (151) is formed substantially perpendicularly to and communicates with the guiding section (152) and may communicate with the inner groove (12).

The at least one pad (16) is mounted on the lower surface of the base (10) to allow the instrument stand to be stably placed on a ground.

Figure 4:
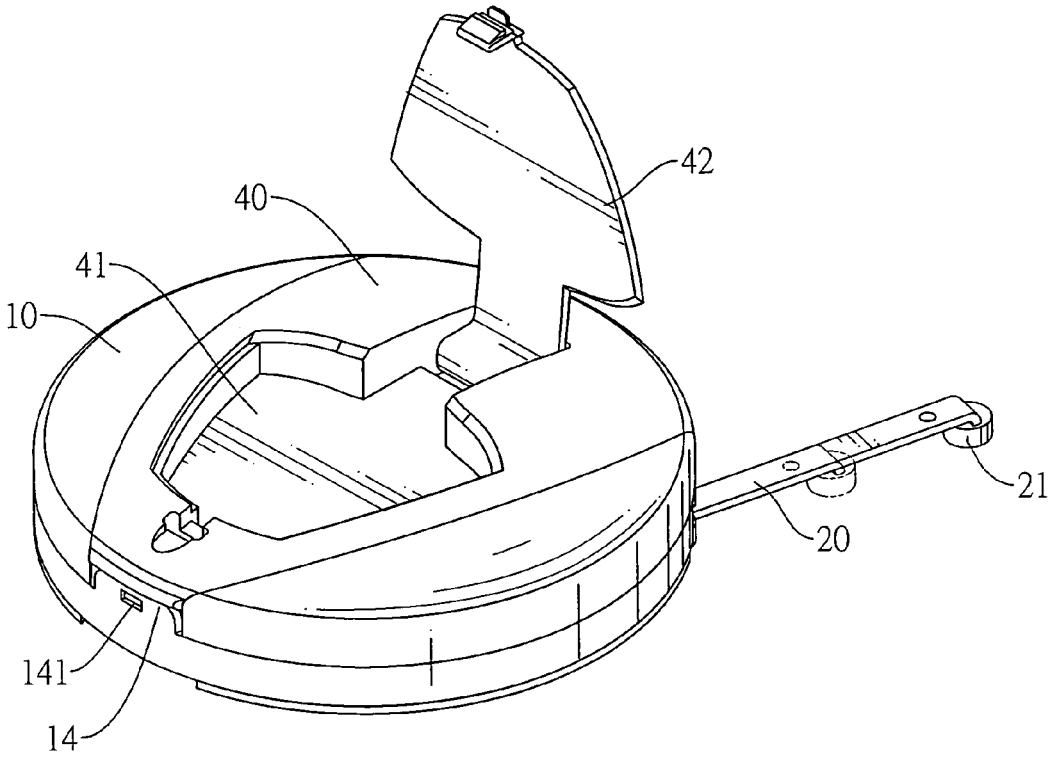
FIG. 4 is a perspective view of the instrument stand in FIG. 1, showing a secondary cover and two legs being unfolded.

With further reference to FIG. 4, the legs (20) are retractably mounted in the side surface of the base (10), may be telescopically mounted retractably, may be respectively adjacent to the sides of the positioning recess (13) of the base (10) and selectively balance the instrument stand when extended and correspond to the base (10) when retracted. Each leg (20) has a distal end and a foot (21). The foot (21) is mounted on the distal end of the leg (20) to allow the instrument stand to be stably placed on the ground without causing damage and may be plastic, rubber or the like.

Figure 6:
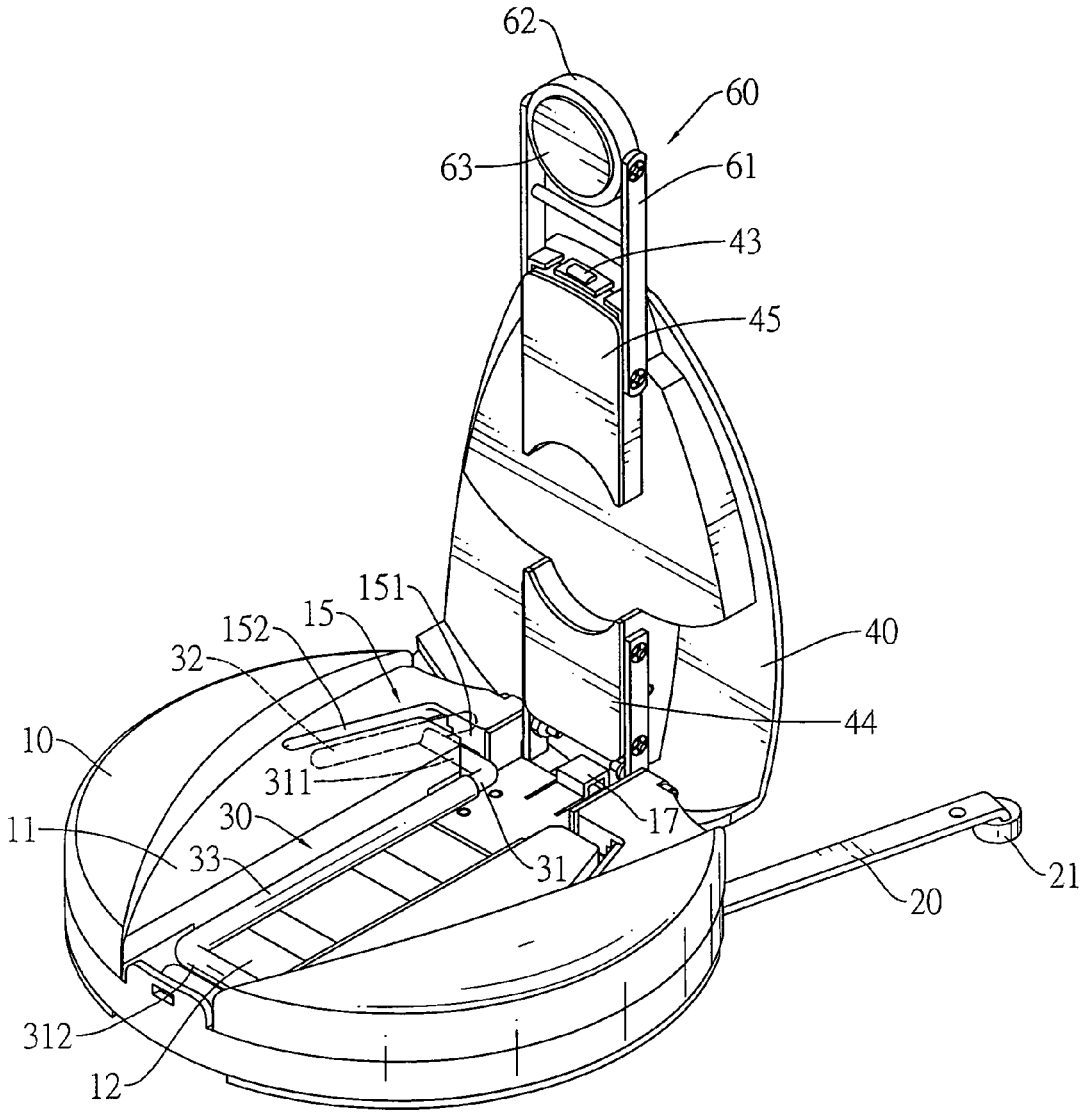
FIG. 6 is a perspective view of the instrument stand in FIG. 1, showing the supporting assembly being unfolded.
Figure 7:
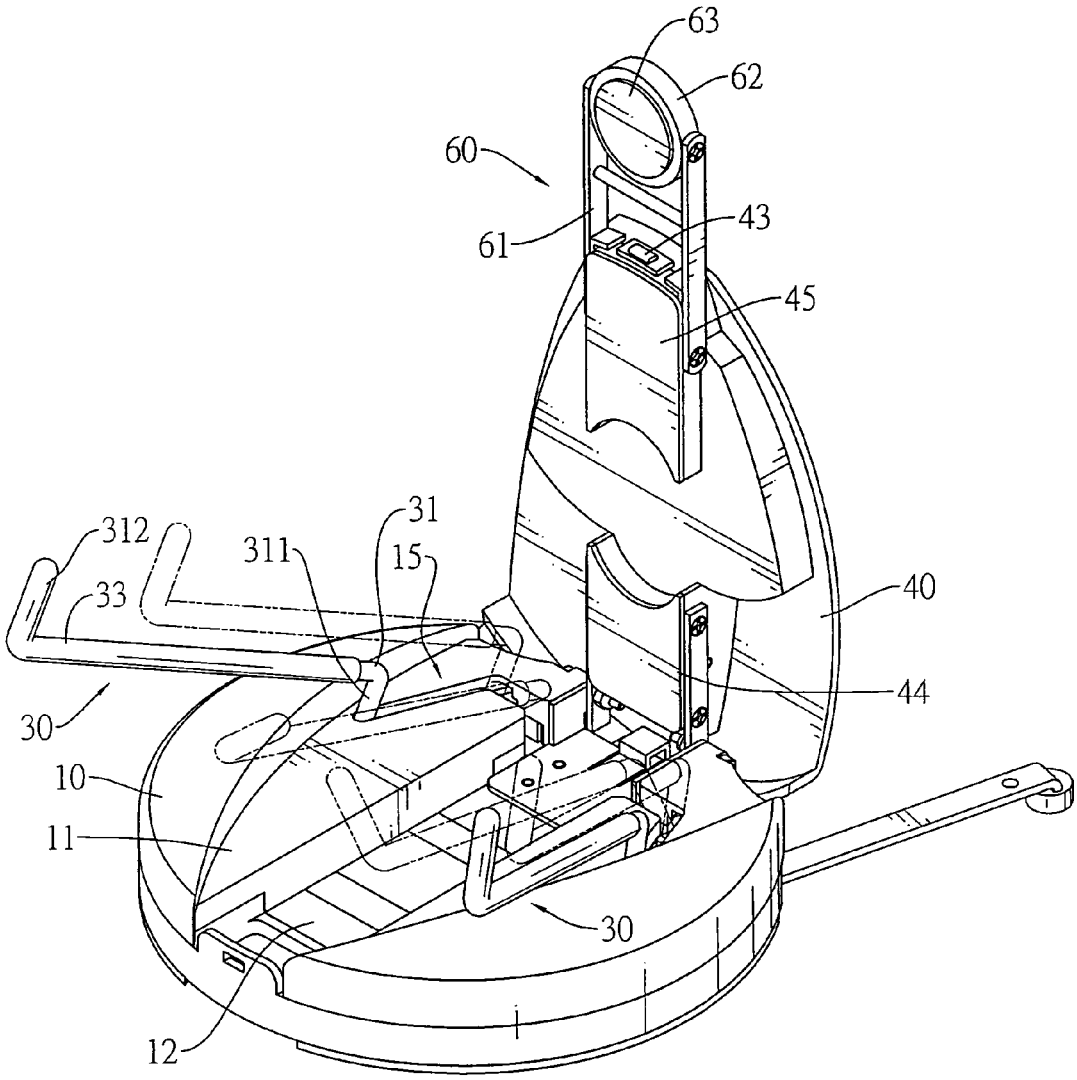
FIG. 7 is a perspective view of the instrument stand in FIG. 1, showing two arms being unfolded.

With reference to FIGS. 6 and 7, the arms (30) are respectively and movably mounted in the arm guides (15) of the base (10). Each arm (30) has a guiding rod (32) and a holding bracket (31) and may have a protective sleeve (33).

The guiding rod (32) is slidably and rotatably mounted in the guiding section (152) of the arm guide (15).

The holding bracket (31) is connected to the guiding rod (32), corresponds to and is selectively disposed in the folding section (151) of the arm guide (15) and in the inner groove (12) of the base (10) and has a connecting end (311) and a holding end (312). The connecting end (311) is substantially perpendicularly attached to the guiding rod (32) and may be selectively disposed in the folding section (151) or abut the guiding section (152) of the arm guide (15). The holding end (312) is shaped to correspond to a stringed instrument and is selectively stored in the inner groove (12) of the base (10).

When the guiding rods (32) move along the guiding sections (152) of the arm guides (15) and the connecting ends (311) of the holding brackets (31) are disposed between the folding sections (151), the guiding rods (32) can be rotated to fold the holding bracket (31) in the folding section (151) of the arm guide (15) and the inner groove (12) of the base (10). When the guiding rods (32) are disposed in the guiding sections (152) of the arm guides (15) and the holding bracket (31) protrude out of the base (10), the arm (30) is maintained unfolded. Therefore the guitar (70) can be held on the arms (30).

The protective sleeve (33) is mounted around the arm (30) to allow the guitar (70) to be held stably on the arms (30) and to prevent the guitar (70) from being damaged and scratched.

Figure 5:
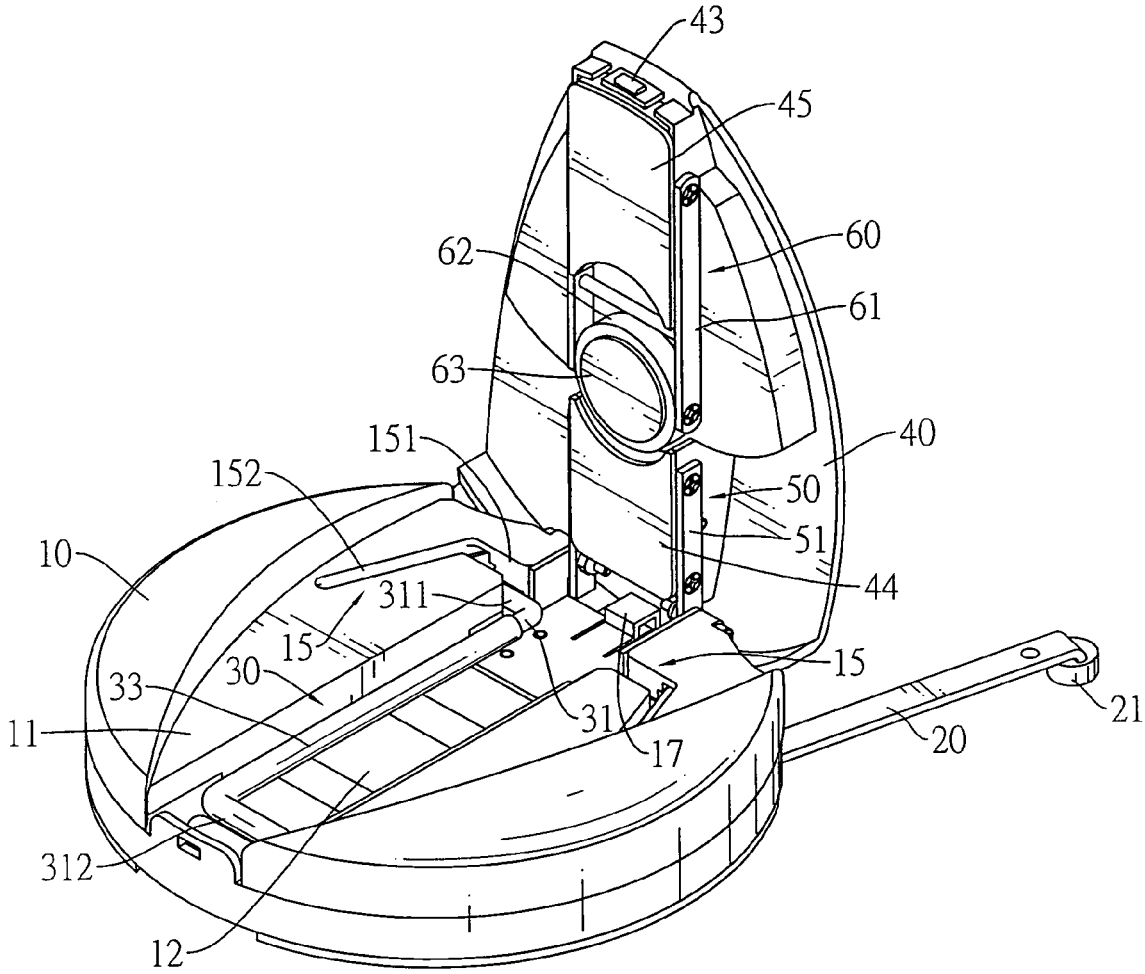
FIG. 5 is a perspective view of the instrument stand in FIG. 1, showing a main cover being unfolded and a supporting assembly being folded.

With further reference to FIG. 5, the main cover (40) is mounted pivotally on the outer platform (11) of the base (10) and has a rear end, a front end, an outer surface, an inner surface, a hook (46), a store recess (41), a secondary cover (42), a latch protrusion (43), a rear positioning protrusion (44) and a front positioning protrusion (45).

The rear end of the main cover (40) corresponds to and is pivotally connected to the rear end of the base (10).

The front end of the main cover (40) corresponds to the front end of the base (10).

The hook (46) is formed on the rear end of the main cover (40) and selectively engages the hook (17) of the base (10) when the main cover (40) is opened relative to the base (10).

The store recess (41) is formed in the outer surface of the main cover (40).

The secondary cover (42) corresponds to and selectively covers the store recess (41) and is pivotally connected to the main cover (40). The store recess (41) is used for storage of items that may include but are not limited to plectrums, strings, capos and dampers.

The latch protrusion (43) is formed on the front end of the main cover (40) and selectively engages the latch hole (141) of the latch (14) of the base (10) to fold the main cover (40) on the base (10) and disengages from the latch hole (141) of the latch (14) of the base (10) to unfold the main cover (40).

The rear positioning protrusion (44) is mounted on the inner surface of the main cover (40), corresponds to the rear end of the main cover (40), is selectively mounted in the inner groove (12) of the base (10) when the main cover (40) is folded on the base (10) and has two opposite side surfaces.

The front positioning protrusion (45) is mounted on the inner surface of the main cover (40), corresponds to the front end of the main cover (40), is selectively mounted in the inner groove (12) of the base (10) when the main cover (40) is folded on the base (10) and has two opposite side surfaces.

The pivot assembly (50) is pivotally mounted between the rear ends of the base (10) and the main cover (40) and has two pivot brackets (51). The pivot brackets (51) are respectively and pivotally connected to the side surfaces of the rear positioning protrusion (44) of the main cover (40) and the sidewalls of the inner groove (12) of the base (10). Therefore, the main cover (40) can pivot relative to the base (10) to fold or unfold the main cover (40).

The supporting assembly (60) is pivotally mounted on front end of the main cover (40) and has two support brackets (61) and a supporter (62).

The support brackets (61) are respectively and pivotally connected to the side surfaces of the front positioning protrusion (45) of the main cover (40). Each support bracket (61) has a proximal end and a distal end. The proximal end of the support bracket (61) is pivotally connected to the corresponding side surface of the front positioning protrusion (45) of the main cover (40). The supporter (62) is pivotally connected between the distal ends of the support brackets (61) and may have a supporting surface and a cushion (63). The cushion (63) is mounted on the supporting surface of the supporter (62) and may be plastic, rubber or the like.

When the support brackets (61) of the supporting assembly (60) pivot relative to the main cover (40), the supporter (62) of the supporting assembly (60) is selectively stored on the inner surface of the main cover (40) between the rear and front positioning protrusions (44, 45) of the main cover (40) and protrudes out of the main cover (40) to lean against a back of the guitar (70). Moreover, the supporter (62) can be rotated relative to the support bracket (61) to allow the cushion (63) of the supporter (62) to fit the back of the guitar. Therefore, the guitar (70) can be stably held on the instrument stand as described and not be scratched.

While unfolding the instrument stand as described, the legs (20), the main cover (40) and the arms (30) are sequentially unfolded relative to the base (10) and the supporting assembly (60) is unfolded relative to the main cover (40). The guitar (70) can be held on the arms (30) and leans against the supporting assembly (60). The legs (20) balance the instrument stand and the guitar (70) to prevent the guitar (70) from falling.

While folding the instrument stand as described, the arms (30) are respectively stored in the arm guides (15) and the inner groove (12) of the base (10), the legs (20) are retracted in the base (10), the supporting assembly (60) is pivoted to be mounted on inner surface of the main cover (40) and the main cover (40) is pivoted to be mounted on the base (10). Thus, the instrument stand is folded, maybe into a disk for convenient transportation and storage.

Figure 8:
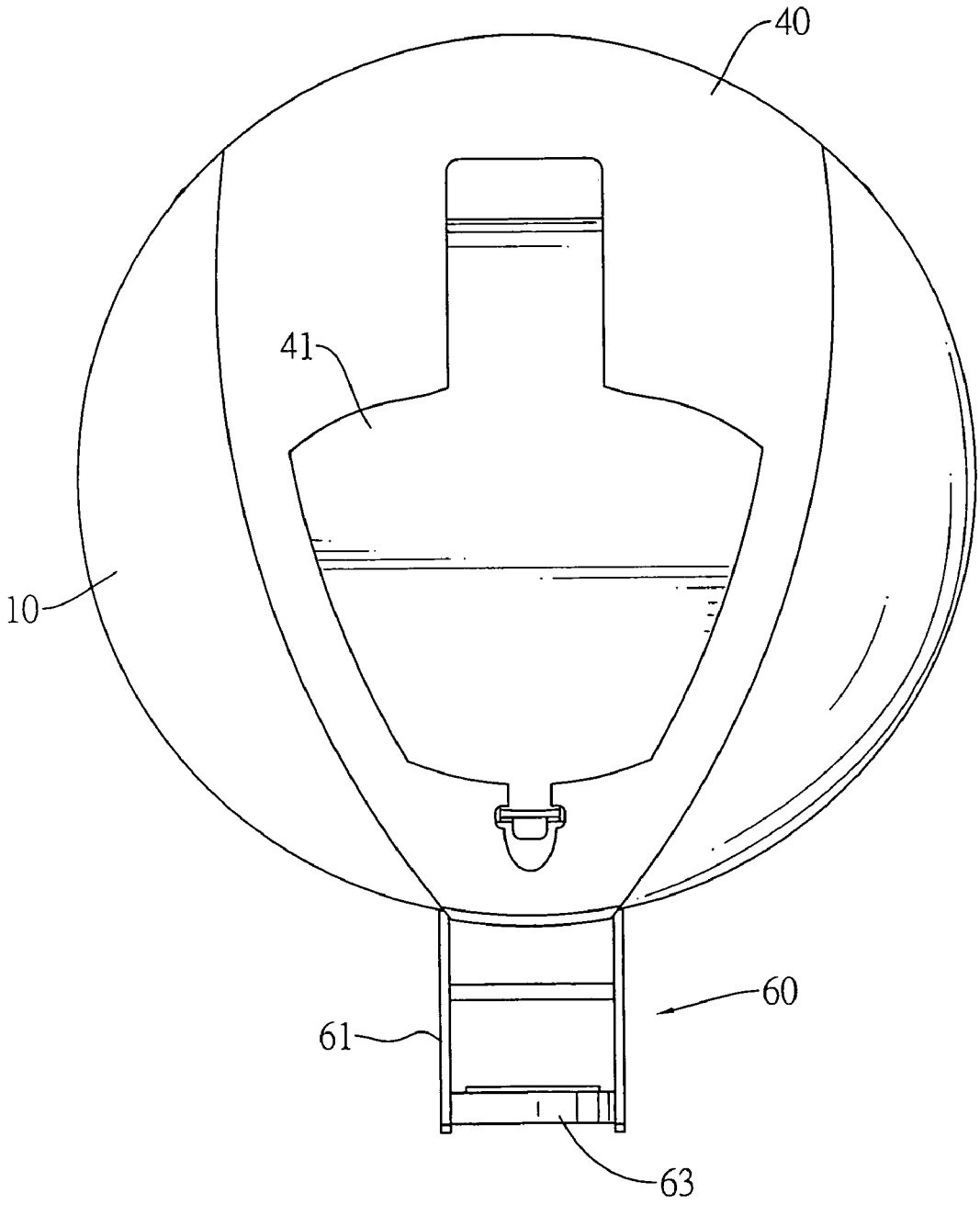
FIG. 8 is a top view of the instrument stand in FIG. 1, showing the main cover being folded and the supporting assembly being unfolded.

With further reference to FIG. 8, when the supporting assembly (60) is not mounted on the inner surface of the main cover (40), the support brackets (61) of the supporting assembly (60) respectively protrude between the sides of the latch (14) and the sidewalls of the inner groove (12) of the base (10). Therefore, the instrument stand can be carried by the supporting assembly (60).

The instrument stand as described is light, aesthetically pleasing, is convenient for carrying and has no sharp protrusions that may damage instruments being carried with the instrument stand or a person carrying the stand so is convenient.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An instrument stand comprising
- a base having
  - an upper surface stepped to form
    - an outer platform formed in the upper surface of the base and having a bottom; and
    - an inner groove formed in the bottom of the outer platform of the base and having
      - a bottom;
      - two opposite sidewalls;
      - a rear open end; and
      - a front open end;
  - a side surface;
  - a front end;
  - a rear end; and
  - two arm guides being formed in the bottom of the outer platform of the base, respectively formed in the sidewalls of the inner groove and communicating with the inner groove and each arm guide having
    - a guiding section; and
    - a folding section communicating with the guide section;
- two arms being respectively and movably mounted in the arm guides of the base and each arm having
  - a guiding rod being slidably and rotatably mounted in the guiding section of a corresponding arm guide; and
  - a holding bracket being connected to the guiding rod, corresponding to and being selectively disposed in the folding section of the corresponding arm guide and having
    - a connecting end being attached to the guiding rod; and
    - a holding end selectively stored in the inner groove of the base;
- a main cover being mounted pivotally on the outer platform of the base and having
  - a rear end;
  - a front end;
  - an inner surface;
  - a rear positioning protrusion mounted on the inner surface of the main cover, corresponding to the rear end of the main cover, being selectively mounted in the inner groove of the base and having two opposite side surfaces; and
  - a front positioning protrusion mounted on the inner surface of the main cover, corresponding to the front end of the main cover, selectively mounted in the inner groove of the base and having two opposite side surfaces; and
- a pivot assembly pivotalty mounted between the rear ends of the base and the main cover and having two pivot brackets respectively and pivotally connected to the side surfaces of the rear positioning protrusion of the main cover and the sidewalls of the inner groove of the base; and
- a supporting assembly pivotally mounted on front end of the main cover and having
  - two support brackets respectively and pivotally connected to the side surfaces of the front positioning protrusion of the main cover and each support bracket having
    - a proximal end pivotally connected to a corresponding side surface of the front positioning protrusion of the main cover; and
    - a distal end; and
  - a supporter being pivotally connected between the distal ends of the support brackets.

2. The instrument stand as claimed in claim 1 further has two legs being retractably mounted in the side surface of the base.

3. The instrument stand as claimed in claim 2, wherein
- the base further has
  - a positioning recess being formed in the side surface of the base, communicating with the inner groove and having two opposite sides; and
  - a hook being mounted on the bottom of the inner groove and adjacent to the rear open end of the inner groove;
- the legs are respectively adjacent to the sides of the positioning recess of the base; and
- the main cover further has a hook being formed on the rear end of the main cover and selectively engaging the hook of the base.

4. The instrument stand as claimed in claim 3, wherein
- the base further has a latch being formed on and independently protruding from the bottom of the inner groove adjacent to the front open end of the inner groove and having
  - two opposite sides; and
  - a latch hole being formed through the latch; and the main cover further has a latch protrusion being formed on the front end of the main cover and selectively engaging the latch hole of the latch of the base.

5. The instrument stand as claimed in claim 4, wherein the main cover further has an outer surface;

a store recess being formed in the outer surface of the main cover; and a secondary cover corresponding to and selectively covering the store recess and being pivotally connected to the main cover.

6. The instrument stand as claimed in claim 5, wherein each arm further has a protective sleeve being mounted around the arm; and the supporter of the supporting assembly further has a supporting surface; and a cushion being mounted on the supporting surface of the supporter.

7. The instrument stand as claimed in claim 6, wherein the base further has a lower surface; and at least one pad being mounted on the lower surface of the base; and each leg further has a distal end; and a foot being mounted on the distal end of the leg.

* * * * *